US005195902A

United States Patent [19]

Bengal

[11] Patent Number: 5,195,902

[45] Date of Patent: Mar. 23, 1993

[54] ELECTRICAL CONNECTOR

[75] Inventor: Ofer Bengal, Kfar Saba, Israel

[73] Assignee: Rit-Rad Interconnection Technologies Ltd., Telaviv, Israel

[21] Appl. No.: 719,768

[22] Filed: Jun. 24, 1991

Related U.S. Application Data

[62] Division of Ser. No. 522,534, May 11, 1990, Pat. No. 5,052,940.

[51] Int. Cl.[5] ..... H01R 13/658; H01R 13/703

[52] U.S. Cl. ..... 439/188; 439/293; 439/607; 439/733; 439/938

[58] Field of Search ..... 439/188, 607–610, 439/400, 404, 405, 284, 293, 295, 733, 938; 29/857, 876, 592.1; 200/51.1

[56] References Cited

U.S. PATENT DOCUMENTS

| | | | |
|---|---|---|---|
| Re. 32,760 | 10/1988 | Chandler | 439/188 |
| 3,869,191 | 3/1975 | Tolnar, Jr. et al. | 439/188 |
| 3,974,960 | 2/1976 | Sugar | 439/468 |
| 4,544,227 | 10/1985 | Hirose | 439/607 |
| 4,582,376 | 4/1986 | Olsson | 200/51.1 |
| 4,597,624 | 7/1986 | Lax et al. | 439/610 |
| 4,679,879 | 7/1987 | Triner et al. | 439/425 |
| 4,702,542 | 10/1987 | Noyes | 439/557 |
| 4,711,507 | 12/1987 | Noorily | 439/292 |
| 4,711,511 | 12/1987 | Noorily | 439/352 |
| 4,718,866 | 1/1988 | Yamaguchi | 439/607 |
| 4,727,118 | 4/1988 | Lockard | 439/293 |
| 4,734,060 | 3/1988 | Kawawada et al. | 439/862 |
| 4,744,769 | 5/1988 | Grabbe et al. | 439/284 |
| 4,830,629 | 5/1989 | Yoshimura | 439/610 |
| 4,891,022 | 1/1990 | Chandler et al. | 439/610 |
| 4,894,019 | 1/1990 | Howard | 439/188 |
| 4,904,196 | 2/1990 | Sueyoshi et al. | 200/51.1 |
| 4,906,201 | 3/1990 | Young et al. | 439/609 |
| 4,916,804 | 4/1990 | Yoshimura et al. | 439/610 |
| 4,988,307 | 1/1991 | Muzslay | 439/188 |
| 5,030,114 | 7/1991 | Carey et al. | 439/610 |
| 5,052,940 | 10/1991 | Bengal | 439/357 |

FOREIGN PATENT DOCUMENTS

| | | | |
|---|---|---|---|
| 0112711 | 7/1984 | European Pat. Off. . | |
| 0148532 | 7/1985 | European Pat. Off. . | |
| 2903896 | 8/1979 | Fed. Rep. of Germany | 439/188 |
| 69606 | 11/1958 | France | 439/79 |

*Primary Examiner*—Neil Abrams
*Attorney, Agent, or Firm*—Ladas & Parry

[57] ABSTRACT

A hermaphroditic self shorting electrical connector including a housing, a plurality of electrical terminals supported within the housing and electrical shunt apparatus including at least one resilient conductive member, positioned and configured such that when the connector is in an unmated condition the resilient conductive member is in electrical contact with at least two electrical terminals and such that mating engagement of the connector with a corresponding connector deflects the resilient conductive member such that it is no longer in electrical contact with at least one of the at least two electrical terminals.

11 Claims, 12 Drawing Sheets

ELECTRICAL CONNECTOR

This is a divisional of copending application Ser. No. 07/522,532 filed on May 11, 1990, now U.S. Pat. No. 5,052,940.

FIELD OF THE INVENTION

The present invention relates generally to electrical connectors and more particularly to hermaphroditic shielded self-shorting electrical connectors.

BACKGROUND OF THE INVENTION

Hermaphroditic shielded self-shorting electrical connectors are known in the market and in the patent literature.

A standard to which many of the electrical connectors are designed is set forth in IBM Technical Publication GA27-3773-1 at paragraph 5 and appendices B.2 and B.3., termed the Technical Interface Specification of the IBM Cabling System.

U.S. Pat. Re. No. 32,760 describes a hermaphroditic self-shorting electrical connector including a two-part connector shield defining plural cable access openings and a shunt arrangement wherein the contact portions of terminals are resiliently deformable from positions engaging shunt means in an unmated condition of the connector to positions spaced from the shunt means in a mated condition of the connector.

U.S. Pat. No. 4,449,778 describes a two-part electrical connector shield having resilient inturned cable gripping lips. U.S. Pat. No. 4,582,376 describes an electrical connector including shunt bars having integrally formed dependent tines. U.S. Pat. No. 4,602,833 describes an electrical connector including shunt means fixed to a dielectric carrier which moves relative to the housing in response to mating engagement of the connector with a similar connector. The shunt means engage the contact terminals remote from contact tongues thereof.

U.S. Pat. No. 4,641,906 describes a shielded electrical connector for shielded cable. U.S. Pat. No. 4,653,825 describes a lower mutually engageable shields and insulative cover means including connector latching members and comprising an integrally molded member covering the shields.

U.S. published patent application No. 87/03383 describes an electrical connector including two part shielding means and a premolded insulative cover fittable thereover. This patent shows structure which permits a self-grounding feature to be realized when a connector is mounted onto a connection panel having non-IBM standard connection apertures, using a special insulative adapter. U.S. Pat. No. 4,682,836 describes a shielded electrical connector including a conductor holding block which includes a pair of electrically conductive shorting elements. U.S. Pat. No. 4,619,494 describes and electrical connector having a housing including a plurality of selectably accessible cable ports. U.S. Pat. No. 4,820,193 describes an electrical connector including apparatus for permitting visual inspection of identifying indicia of leads and comparison thereof with corresponding indicia on a conductor holding block.

U.S. Pat. No. 4,711,507 describes an electrical connector with one type of apparatus for preventing inadvertent decoupling of mated connectors. U.S. Pat. No. 4,711,511 describes an electrical connector with another type of apparatus for preventing inadvertent decoupling of mated connectors.

SUMMARY OF THE INVENTION

The present invention seeks to provide an improved electrical connector of the general type described hereinabove.

There is thus provided in accordance with a preferred embodiment of the present invention a hermaphroditic self shorting electrical connector including a housing, a plurality of electrical terminals supported within the housing and electrical shunt apparatus including at least one resilient conductive member, positioned and configured such that when the connector is in an unmated condition the resilient conductive member is in electrical contact with at least two electrical terminals and such that mating engagement of the connector with a corresponding connector deflects the resilient conductive member such that it is no longer in electrical contact with at least one of the at least two electrical terminals.

In accordance with one embodiment of the invention, the resilient conductive member is preloaded against said at least two electrical terminals to provide good electrical contact therewith.

There is also provided in accordance with a preferred embodiment of the present invention a hermaphroditic self shorting electrical connector including a housing, a plurality of electrical terminals supported within the housing and at least first latch apparatus pivotably mounted on the housing and including a front portion arranged for engagement with a corresponding connector and a rear portion arranged for engagement with the housing for preventing inadvertent disengagement of mated connectors.

There is additionally provided in accordance with a preferred embodiment of the present invention a hermaphroditic electrical connector including a housing, a plurality of electrical terminals supported within the housing and a unitary electrical shield disposed within the housing, at least partially surrounding the electrical terminals Further in accordance with a preferred embodiment of the present invention there is provided a hermaphroditic self shorting electrical connector including a housing, a plurality of electrical terminals supported within the housing and electrical shielding apparatus including integrally formed conductive protrusions for providing automatic grounding of the connector when said connector is coupled onto a conductive panel having IBM standard connection apertures. The automatic grounding is achieved without the need of an adapter which is required in the prior art.

Additionally in accordance with a preferred embodiment of the present invention there is provided a hermaphroditic electrical connector including a housing and a plurality of electrical terminals supported within the housing, the housing including a cable access port and external cable engagement apparatus selectably mountable on the exterior of the housing for retaining a cable extending through the port in a desired bent orientation.

In accordance with an embodiment of the invention, the electrical terminals are directly connectable to a printed circuit board. The electrical terminals may be configured to provide a straight connection to a printed circuit board. Alternatively, the electrical terminals may be configured to provide a side-going connection to a printed circuit board.

There is also provided in accordance with a preferred embodiment of the present invention a method for connecting a multiconductor cable onto an electrical connector which includes a housing, a plurality of electrical terminals supported within the housing in an interconnection module, a conductor connection block, and a shield including the steps of:

stripping the outer insulation off of a first length of cable;

inserting the housing and shield over the cable;

connecting the conductors to the connection block;

inserting the connection block into operative engagement with the module to automatically pierce the insulation on the conductors and establish electrical contact between the conductors and the terminals;

positioning the shield over the module in shielding relationship therewith; and moving the housing over the shield and the module.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
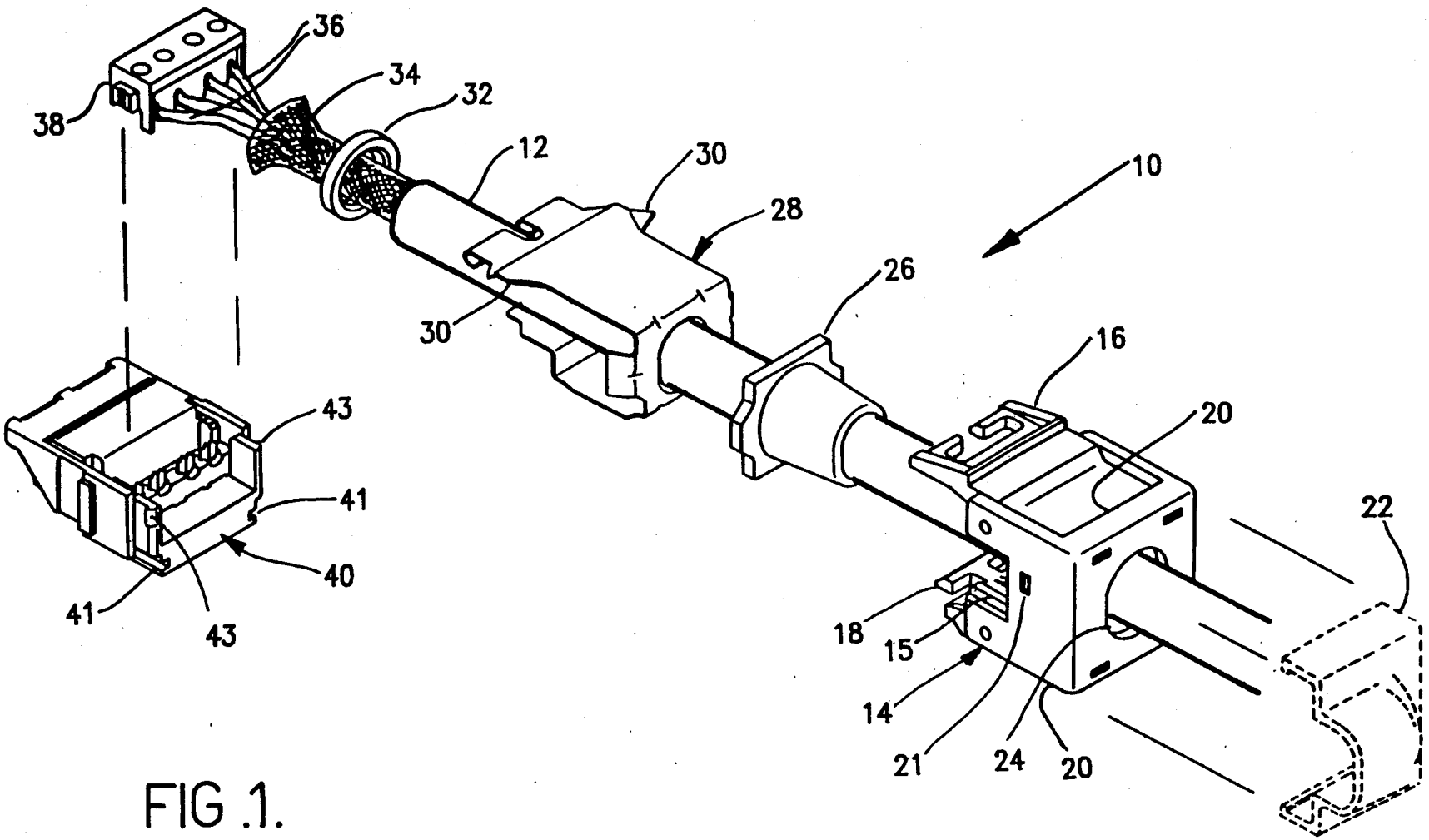
FIG. 1 is an exploded view illustration of an hermaphroditic connector constructed and operative in accordance with a preferred embodiment of the present invention, connected to a multiconductor cable.

Reference is now made to FIG. 1, which illustrates, in exploded view, an hermaphroditic, self-shunting connector 10 constructed and operative in accordance with a preferred embodiment of the present invention, coupled to a multiconductor cable 12.

The connector comprises a housing 14, having first and second pivotably mounted latches 16 and 18. Housing 14 defines first and second retaining shoulders 20, which are arranged to accommodate an optional cable bending adapter 22.

Arranged to be disposed partially inside housing 14 and to extend through a cable access port 24 defined at the rear thereof is a cable grommet 26, preferably formed of a flexible material in order to accommodate various cable cross sectional configurations. Cable grommet 26 is normally used when a straight cable connection is desired and in such a case, adapter 22 is not employed. Conversely, when a bent cable connection is desired, grommet 26 is not employed and adapter 22 is used.

Arranged to be disposed within housing 14 is an integral connector shield 28. It is a particular feature of the integral connector shield 28, that in contrast to non-integral shield assemblies in the prior art, it does not require assembly and generally surrounds the cable interconnections of the connector 10. It is also a particular feature of the shield 28 that it includes protrusions 30, which serve to provide an automatic grounding function when the connector is mounted onto a connection panel having IBM standard mounting apertures, as will be described hereinbelow.

Arranged to be disposed within the shield 28 is a shielding braid connection ring 32, about which the exposed braid 34 of cable 10 is wound to establish shielding connection between the braid and the shield 28. The individual conductors 36 of the cable 10 are connected to a connection block 38 of an interconnection module 40, which will be described in detail.

It is a particular feature of the present invention that the connector of FIG. 1 may be conveniently mounted onto a cable without the use of special tools or facilities and is suitable for field mounting. In accordance with a preferred embodiment of the present invention, the mounting technique includes the following steps:

1. stripping the outer insulation off of a first length of cable 12;

2. inserting housing 14, grommet 26 (when a straight cable exit is desired) and shield 28 over the cable 12;

3. placing ring 32 over the shielding braid 34;

4. folding and wrapping the shielding braid over ring to establish a conductive shielding connection therebetween;

5. connecting the conductors 36 to the connection block 38;

6. inserting the connection block 38 into operative engagement with module 40 to automatically pierce the insulation on conductors 36 and establish electrical contact between conductors 36 and the terminals of module 40;

7. positioning shield 30 over module 40 in shielding relationship therewith and in conductive engagement with ring 32 and shielding braid 34;

8. moving the grommet 26 (if provided) into touching engagement with shield 28;

9. moving housing 14 over shield 28 and module 40, such that grommet 26 (when provided) extends through aperture 24, such that grooves 41 on module 40 engage corresponding grooves 15 on housing 14 and such that protrusions 43 lockingly engage sockets 21 on housing 14.

Figure 2:
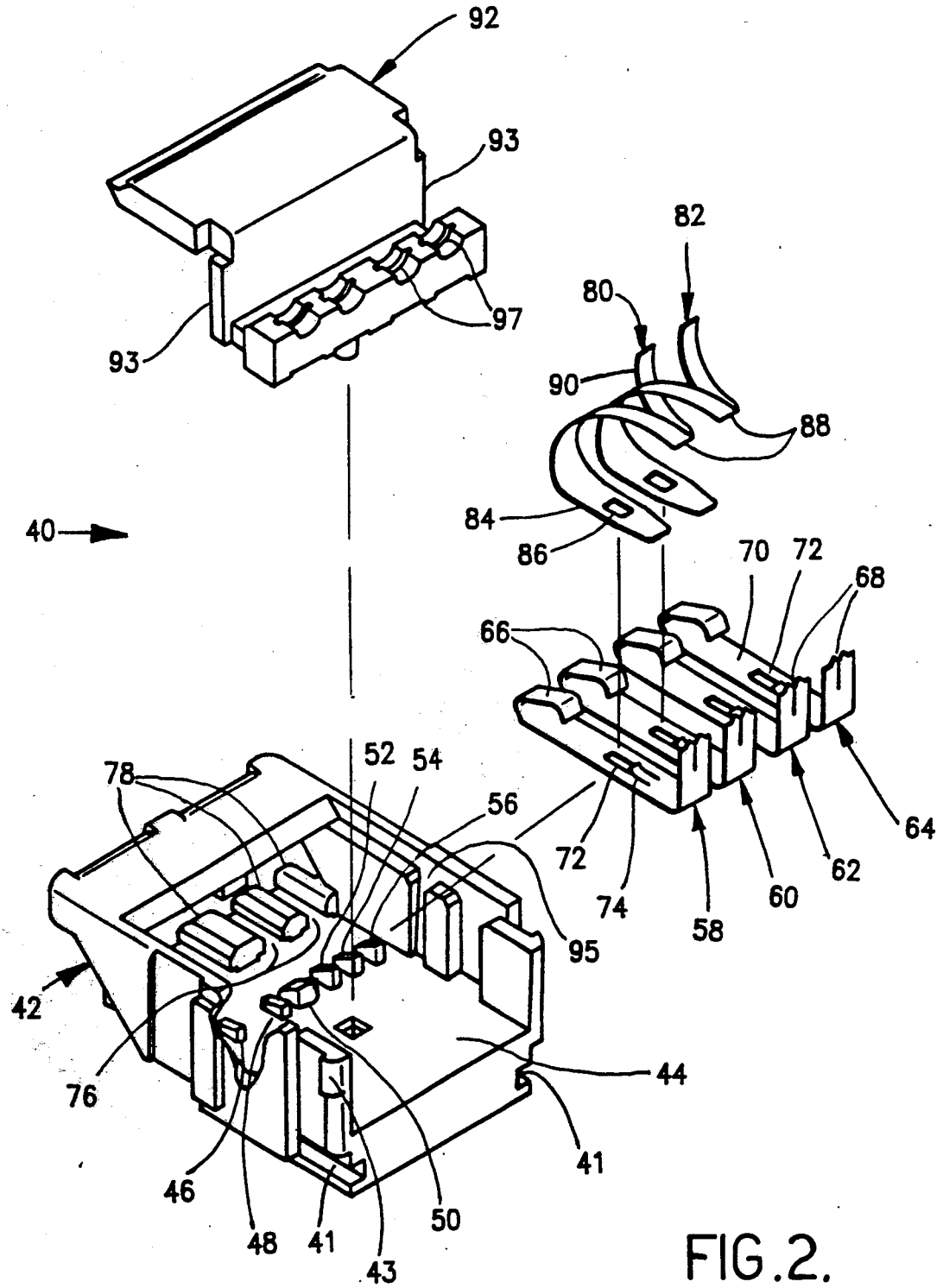
FIG. 2 is an exploded view illustration of an interconnection module forming part of the connector of FIG. 1.

Referring now additionally to FIG. 2, the construction of the interconnection module 40 will now be described. The module includes a base portion 42, which is typically injection molded in one piece of a plastic material. The base portion 42 defines a floor surface 44, from which extend upwardly six teeth 46, 48, 50, 52, 54 and 56.

Electrical terminals 58, 60, 62 and 64 are each formed with a bent over forward contact surface 66 and a rear conductor connection grip 68 which are joined by a generally planar central portion 70, which is formed with a mounting aperture 72, adjacent to which is formed a slightly upwardly bent tine 74.

Electrical terminals 58, 60, 62 and 64 are seated on respective teeth 46, 48, 52 and 56, which extend through apertures 72. Central portions 70 of the terminals 58, 60, 62 and 64 partially extend through channels 76 defined by undercuts formed in adjacent forward protrusions 78.

In accordance with a preferred embodiment of the present invention, resilient shunt members 80 and 82 are provided. In the preferred embodiment of the present invention, the resilient shunt members 80 and 82 comprise conductive springs having a generally helical configuration, such that both shunt members 80 and 82 define a mutually non-contacting double helix. Each of shunt members 80 and 82 includes a base portion 84 having formed therein a mounting aperture 86, as well as a displaceable terminal contact portion 88 and a mating engagement portion 90.

Shunt members 80 and 82 are mounted onto respective teeth 46 and 48 over electrical terminals 58 and 60 and in good electrical connection therewith, due in part to the action of tines 74. It is noted that shunt members 80 and 82 are configured such that they are capable of establishing contact with adjacent electrical terminals as well. In the illustrated embodiment, as will be described hereinafter in greater detail, shunt member 80 is arranged for selectable electrical contact with terminal 62 and shunt member 82 is arranged for selectable electrical contact with terminal 64.

A cover member 92 is arranged for engagement with base portion 42 over terminals 58, 60, 62 and 64 and shunt members 80 and 82. It is a particular feature of the present invention that the cover member 92 and the base portion 42 together define a closed compartment for the terminals and the shunt members, generally preventing contamination thereof. Cover member 92 includes locating walls 93 which seat in channels 95 formed in the base portion 42. Cover member 92 also includes slits 97 which permit grips 68 to extend therethrough for engagement with conductors 36.

Operation of the shunt members 80 and 82 in providing an automatic shunting function in accordance with a preferred embodiment of the present invention will now be described in greater detail with additional reference to FIGS. 3A-3C, 4A, 4B, 5A and 5B.

Figure 3A:
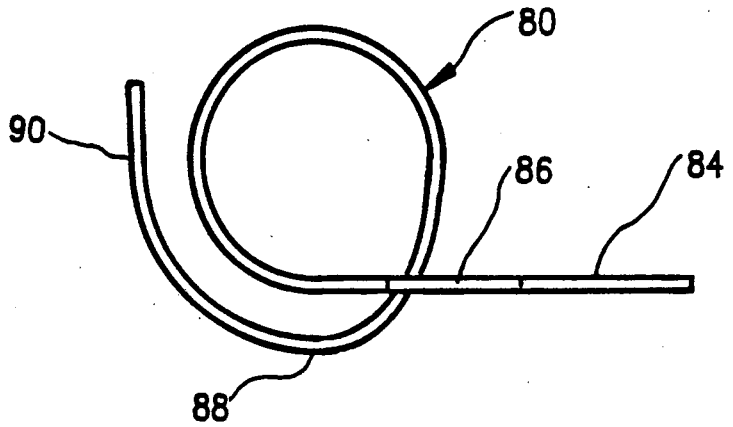
FIGS. 3A, 3B and 3C illustrate three alternative orientations of a shunt member forming part of the interconnection module of FIG. 2.
Figure 3B:
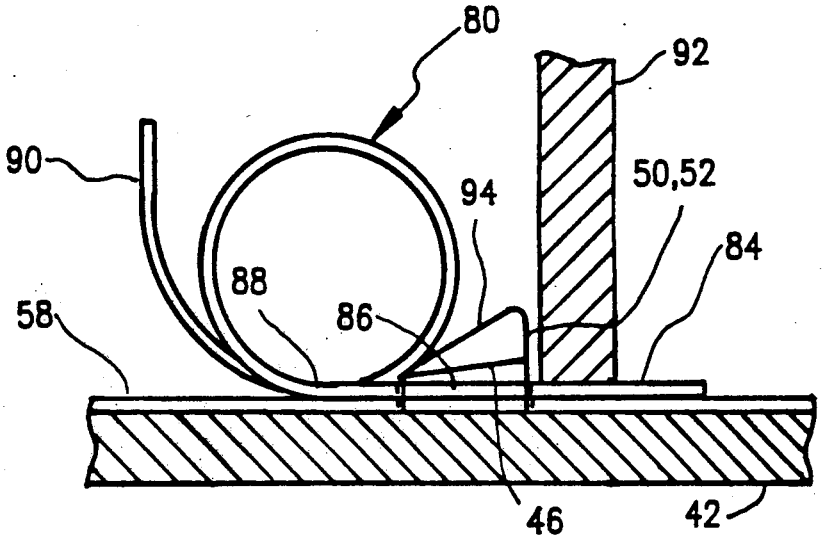
Figure 3C:
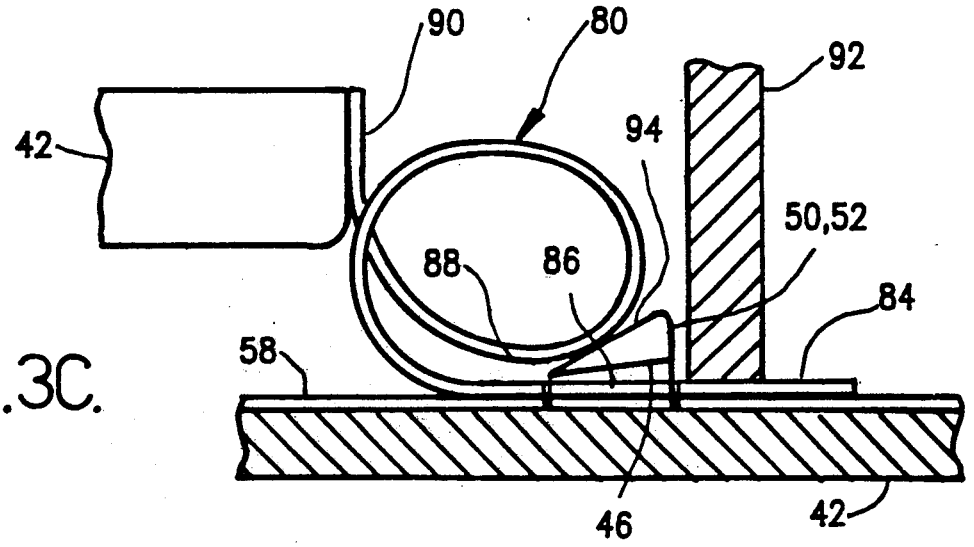

As is seen in FIGS. 3A, 3B and 3C, the shunt members 80 and 82 each have three different operative orientations. FIG. 3A illustrates an at rest orientation of shunt member 80, wherein it is seen that part of the contact portion 88 extends below the base portion 84. FIG. 3B illustrates the orientation of shunt member 80 when installed over terminal 58 onto tooth 46 and secured in position by cover member 92. It is seen that the contact portion 88 is raised to approximately the same level as base portion 84, and is thus preloaded, exerting a compressive force at contact portion 88.

Figure 4B:
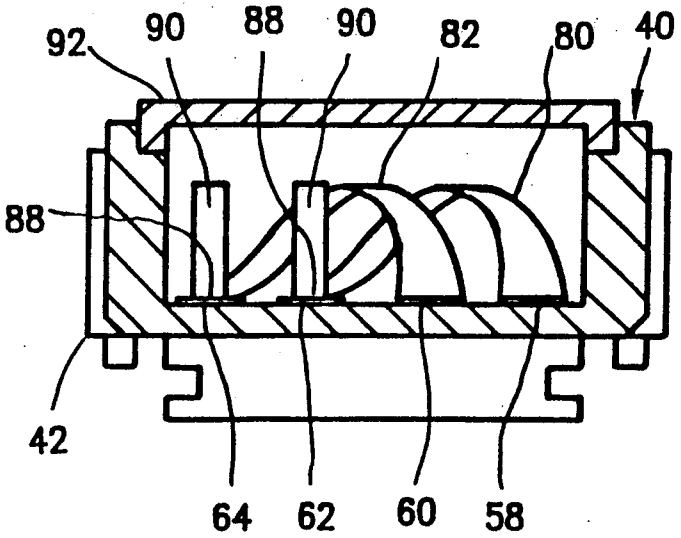
FIGS. 4A and 4B are respective sectional side and front view illustrations of the interconnection module in an unmated operative orientation.
Figure 4A:
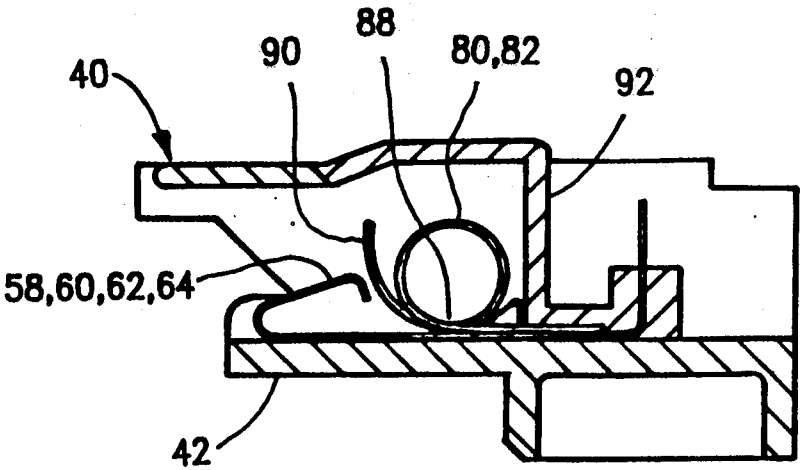

Referring additionally to FIGS. 4A and 4B, it is seen that in the absence of mating contact of the connector, the contact portion 88 of shunt member 80 lies in compression against electrical terminal 62, while at the same time, the contact portion 88 of shunt member 82 lies in compression against electrical terminal 64. Accordingly, in the absence of mating contact of the connector, as illustrated in FIGS. 4A and 4B, the shunt members 80 and 82 are operative to provide shunting respectively between terminals 58 and 6 and between terminals 60 and 64.

Figure 5B:
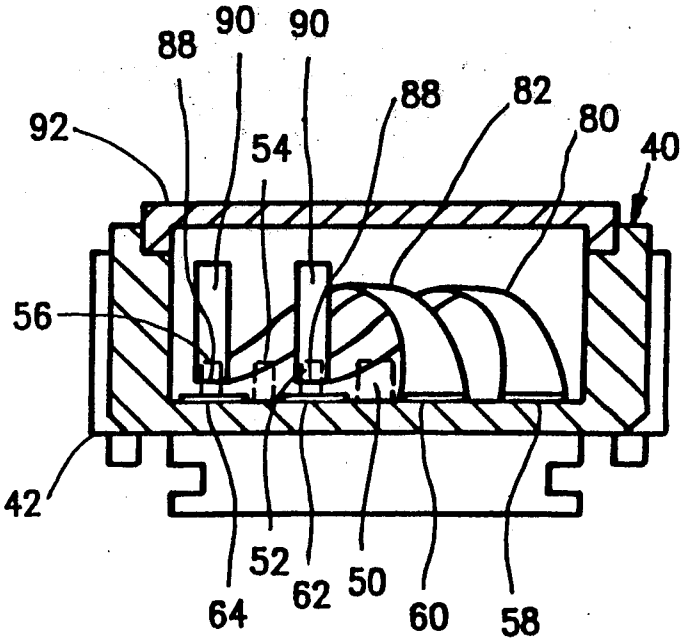
FIGS. 5A and 5B are respective sectional side and front view illustrations of the interconnection module in a mated operative orientation.
Figure 5A:
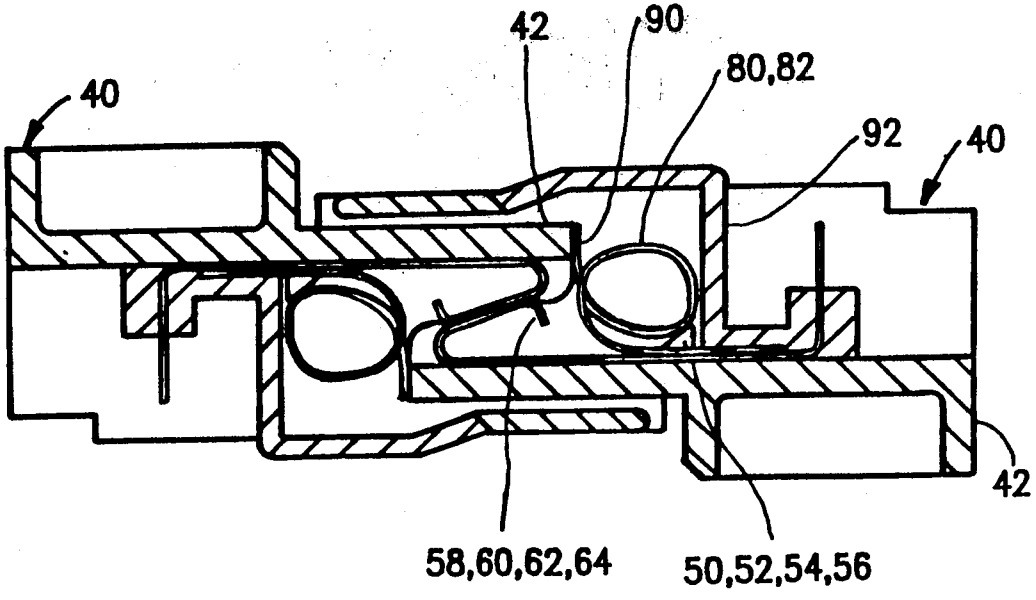

When mating contact is established with the module 40 of a corresponding connector, as illustrated in FIGS. 5A and 5B, the base portion 42 of the module 40 of the corresponding connector is inserted against engagement portions 90 of shunt members 80 and 82, causing reorientation of the shunt members 80 and 82, as illustrated in FIG. 3C for shunt member 80. This reorientation causes displacement of the helix defined by each of the shunt members 80 and 82, resulting in a portion of the contact portion 88 climbing up an inclined surface 94 which is defined on each of teeth 50, 52, 54 and 56.

As can be seen most clearly in FIGS. 5A and 5B, upon mating engagement of two connectors, shunt member 80 is caused to climb up the inclined surface 94 of tooth 52 onto which electrical terminal 62 is mounted, thereby causing a break in the electrical connection between shunt member 80 and terminal 62, and thus eliminating the shunt between terminals 58 and 62. The shunt member 80 normally also climbs up the inclined surface 94 of adjacent tooth 50, which assists in breaking the electrical connection between shunt member 80 and terminal 62.

Similarly, upon mating engagement of two connectors 10, shunt member 82 is caused to climb up the inclined surface 94 of tooth 56 onto which electrical terminal 64 is mounted, thereby causing a break in the electrical connection between shunt member 82 and terminal 64 and thus eliminating the shunt between terminals 60 and 64. The shunt member 82 normally also climbs up the inclined surface 94 of adjacent tooth 54, which assists in breaking the electrical connection between shunt member 82 and terminal 64.

Figure 6:
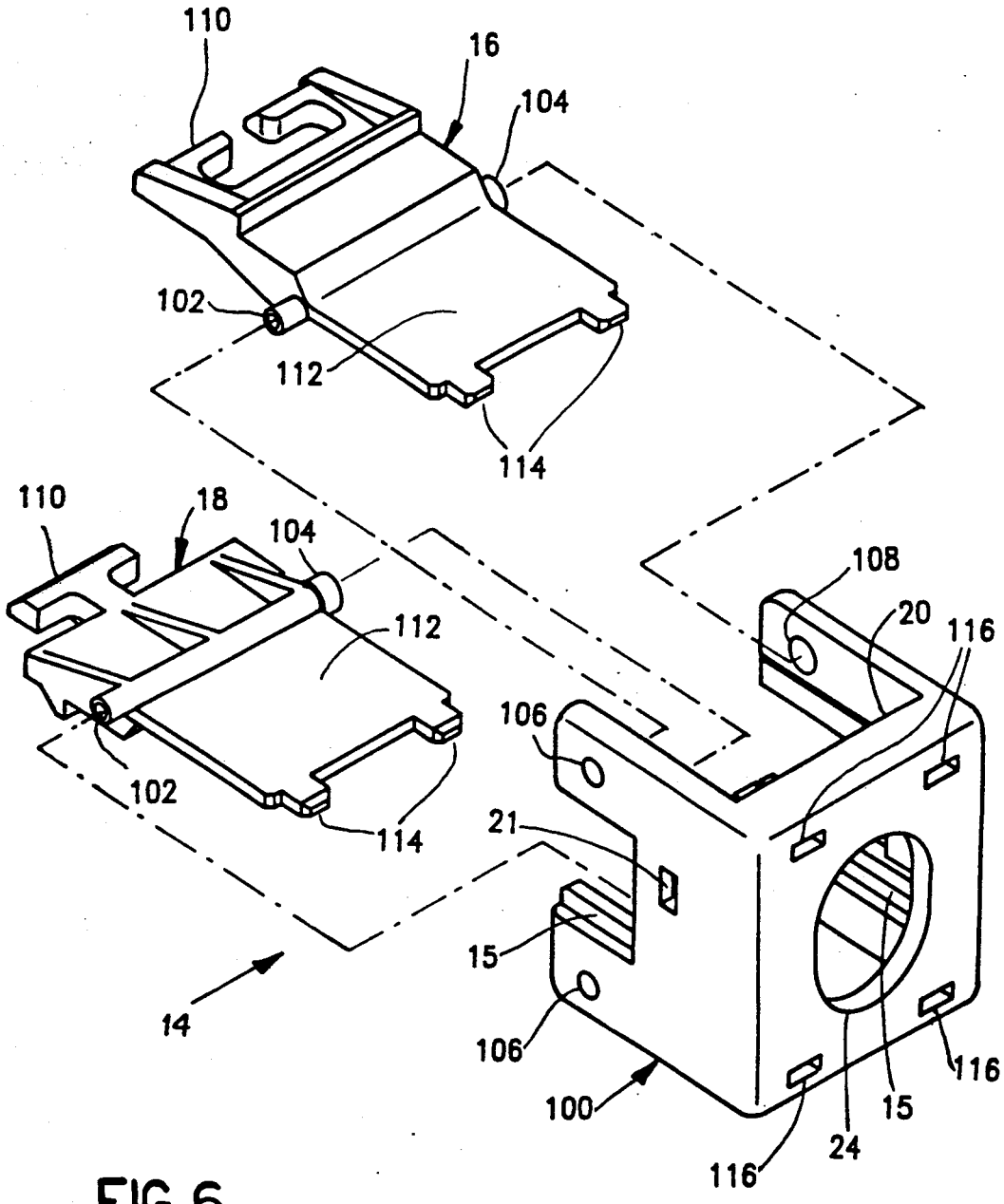
FIG. 6 is an exploded view illustration of the housing of the connector of FIG. 1, illustrating the structure of the latches forming part thereof.

Reference is now made to FIG. 6, which illustrates in detail the construction and mounting of latches 16 and 18 onto a main portion 100 of housing 14. It is seen that each of latches 16 and 18 includes integrally formed pivot axles 102 and 104 which are arranged to be pivotably mounted in respective axle mounts 106 and 108 formed on opposite sides of main portion 100, as shown.

Each of latches 16 and 18 is seen to include a forward coupling portion 110 which lies forwardly of axles 102 and 104 and a rear portion 112, which lies behind axles 102 and 104. Mounting portion 110 of latch 16 provides a female coupling, while mounting portion 110 of latch 18 provides a corresponding male coupling. Rear portion 112 preferably includes a pair of rearwardly extending protrusions 114, which are seated in corresponding apertures 116 formed in main portion 100 in the assembled connector.

The structure and assembly of latches 16 and 18 onto main portion 100 according to a preferred embodiment of the invention retains latches 16 and 18 against undesired decoupling from a mating connector or a connection panel by stiffening the latches 16 and 18 with respect to their rotation about axles 102 and 104. This stiffening is produced by the engagement of the protrusions 114 of rear portion 112 in apertures 116.

Figure 7A:
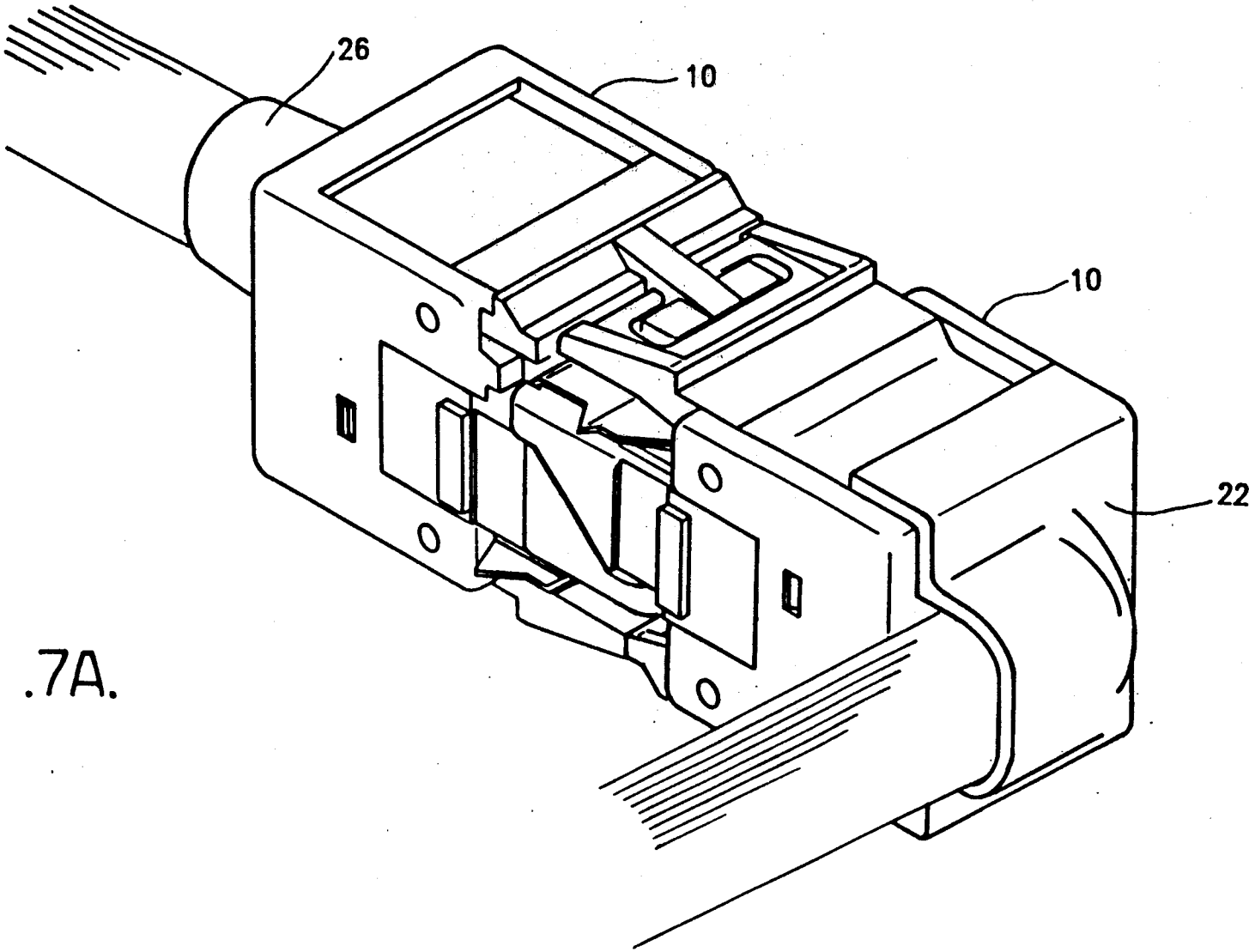
FIG. 7A illustrates two connectors of the present invention having different types of cable direction arrangements.
Figure 7B:
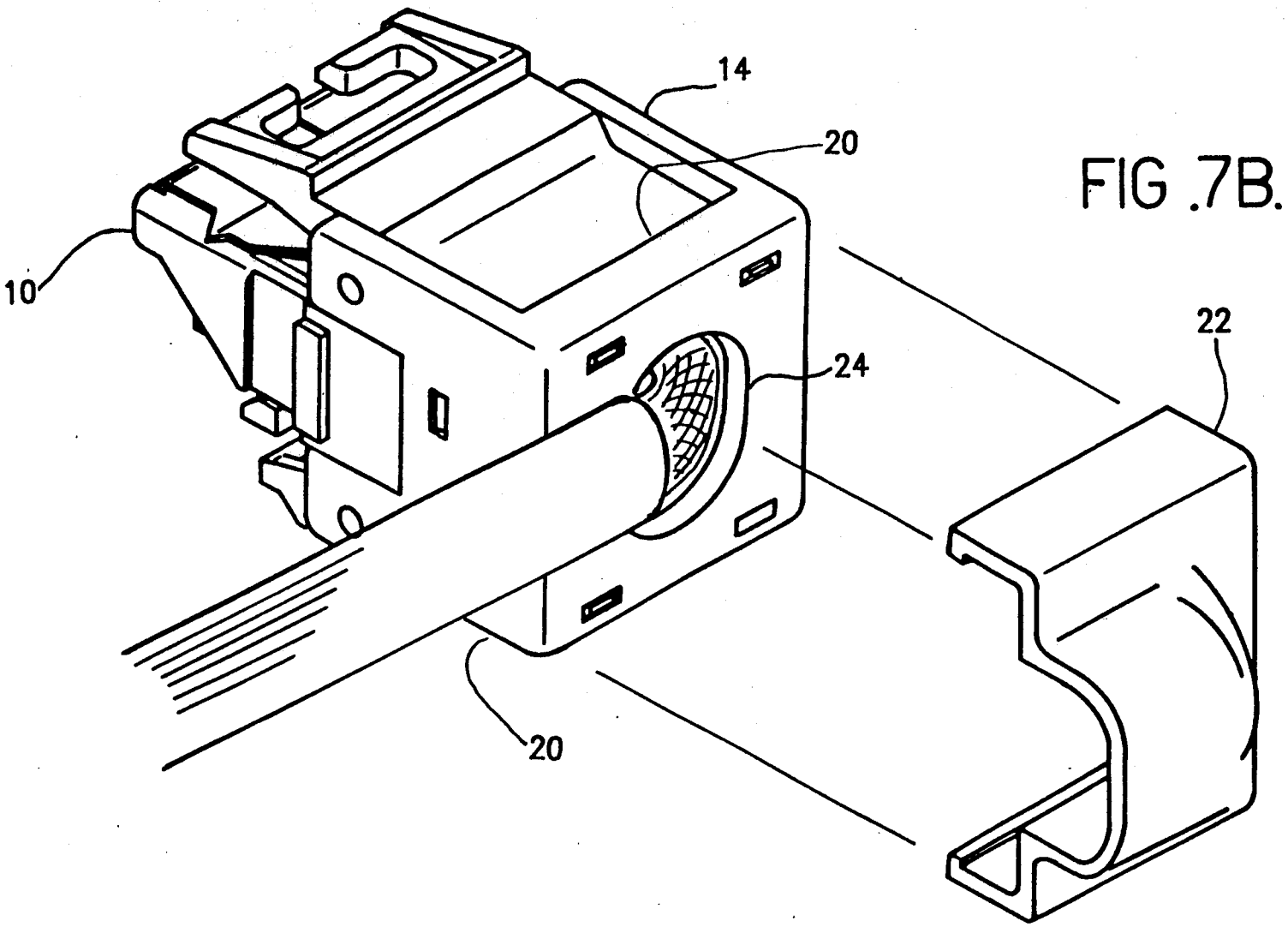
FIG. 7B illustrates a side-going cable connection arrangement.

Reference is now made to FIG. 7A which illustrates two connectors 10 in mating engagement. It is seen that one of connectors 10 has a side going cable exit employing cable bending adapter 22 and that the other of connectors 10 has a straight cable exit and employs grommet 26. FIG. 7B illustrates the arrangement of cable bending adapter 22 over housing 14. It is seen in FIG. 7B, that the outer insulation of the cable is stripped sufficiently to enable the unstripped portion to exit housing 14 at cable access port 24 and to be bent thereat.

The cable bending adapter 22 is snap fit onto housing 14 in engagement with first and second retaining shoulders 20 to retain the cable in the desired side-going configuration. It is appreciated that exit of the cable in an opposite direction is achieved by simply mounting cable bending adapter in an opposite direction onto housing 14.

Figure 7C:
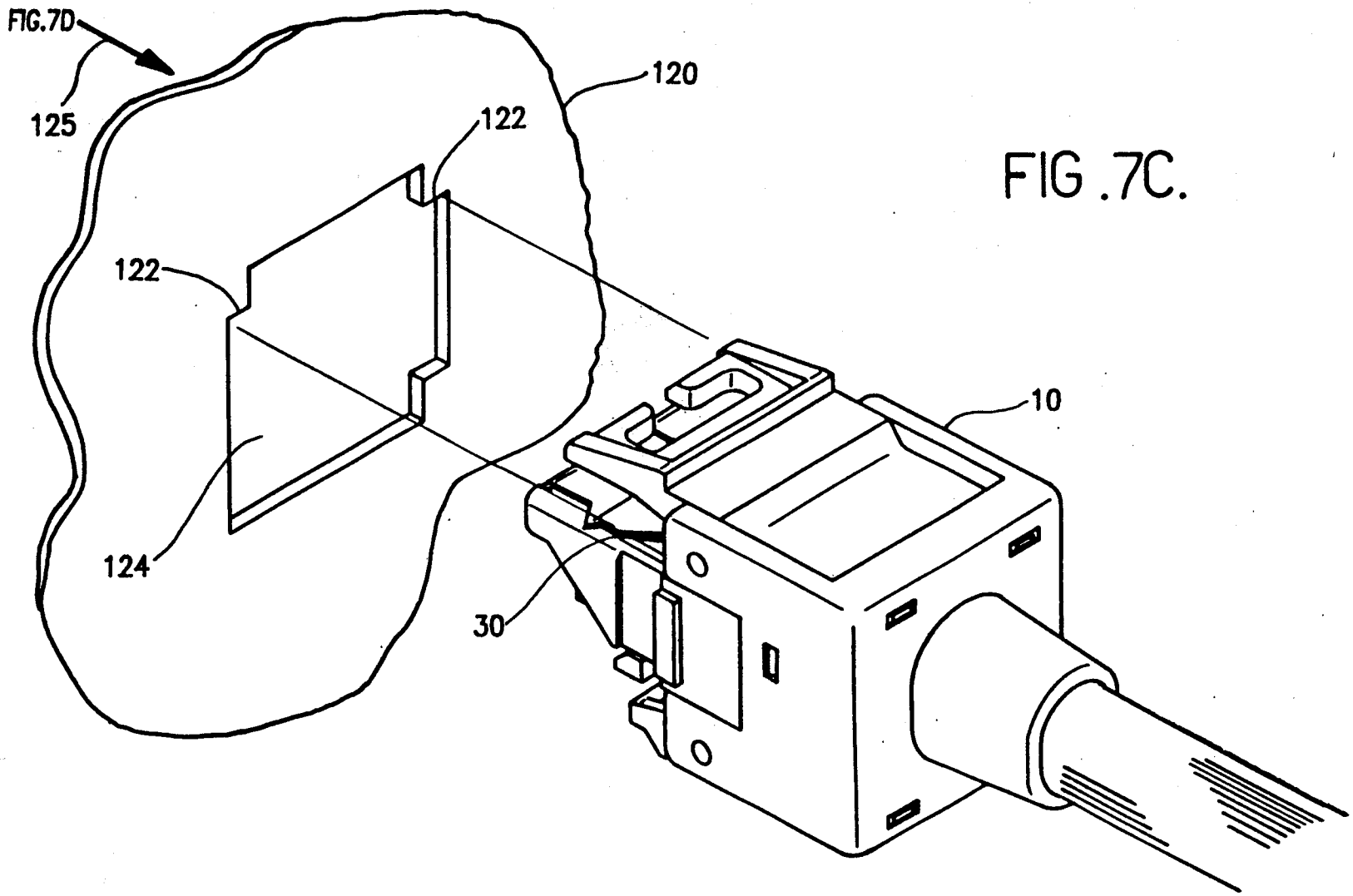
FIG. 7C illustrates the connector of the present invention in association with a connection panel having an IBM standard mounting aperture.
Figure 7D:
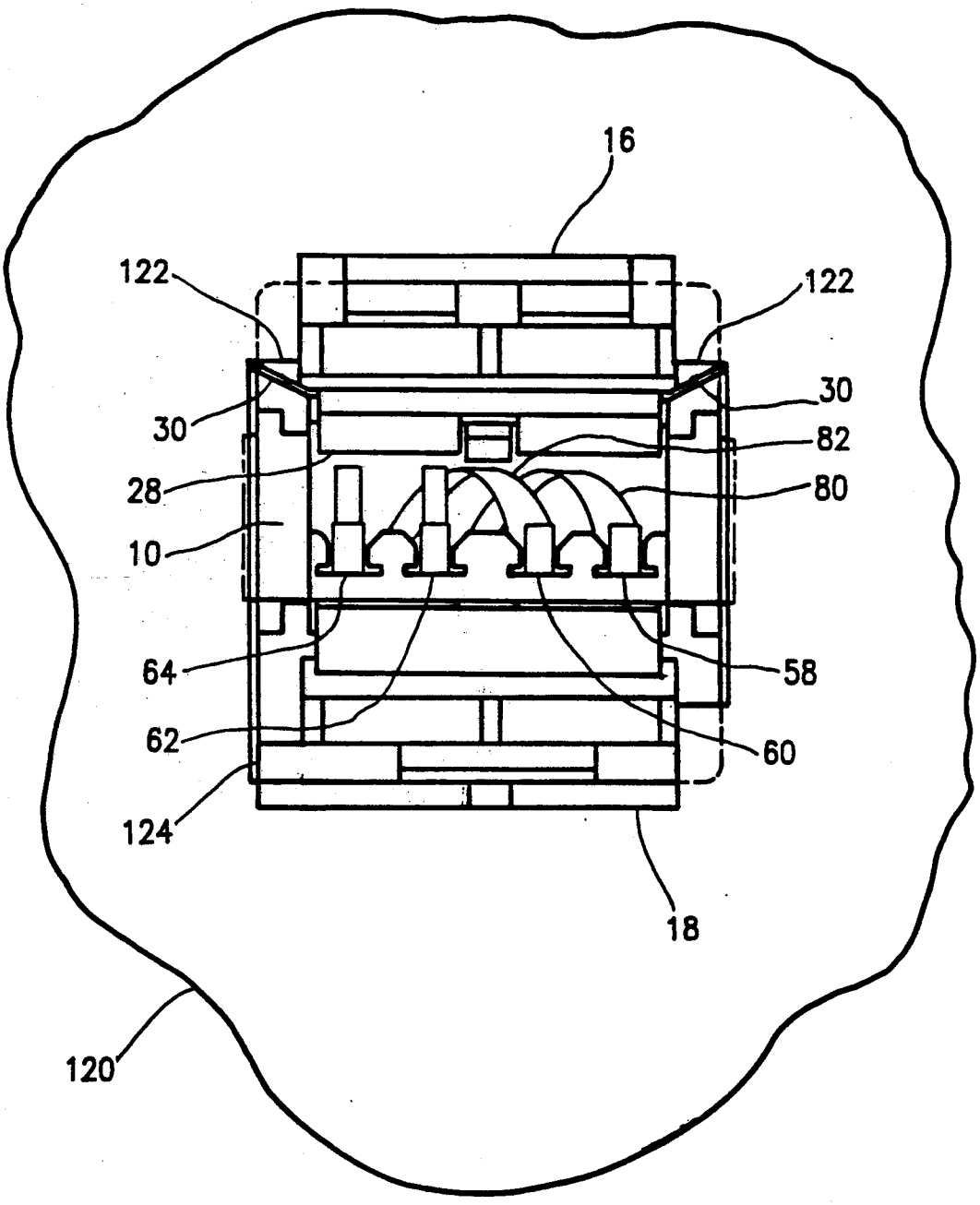
FIG. 7D illustrates a detail of a self-grounding feature provided by the arrangement of FIG. 7C as seen from behind the connection panel as indicated by an arrow 125 in FIG. 7C.

Reference is now made to FIGS. 7C and 7D which illustrate the association of a connector 10 constructed and operative in accordance with the present invention with a connection panel 12 including IBM standard mounting apertures 124.

In accordance with a preferred embodiment of the present invention, the connector 10 provides a self-grounding feature in association with the connection panel 120 having IBM standard mounting apertures 124. This is realized preferably by means of protrusions 30, integrally formed with shield 28, which electrically engage corresponding edge surfaces 122 of the connection panel 120, when the connector 10 is mounted thereon within an aperture 124 formed therein, as illustrated in FIG. 7D.

It is appreciated that during engagement of connector 10 with connection panel 120 the protrusions 30 are caused to resiliently deflect and are thus preloaded against edge surfaces 122, exerting compressive force thereon.

Reference is now made to FIGS. 8A, 8B, 9A and 9B which illustrate different alternative configurations of terminals and corresponding interconnection modules constructed and operative in accordance with additional embodiments of the invention and particularly suitable for use with printed circuit boards.

Figure 8A:
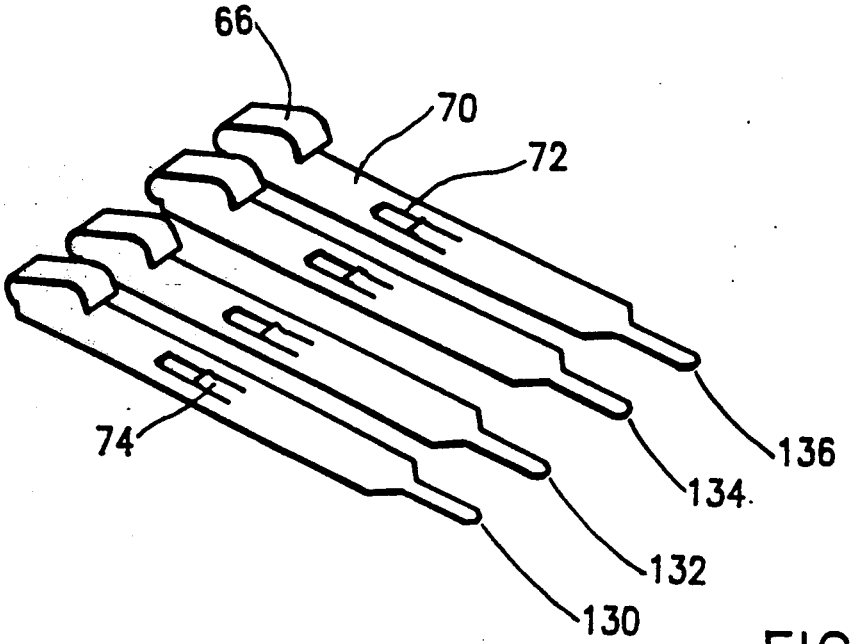
FIGS. 8A and 8B are pictorial illustrations of two different alternative configurations of terminals useful in accordance with an embodiment of the present invention.
Figure 8B:
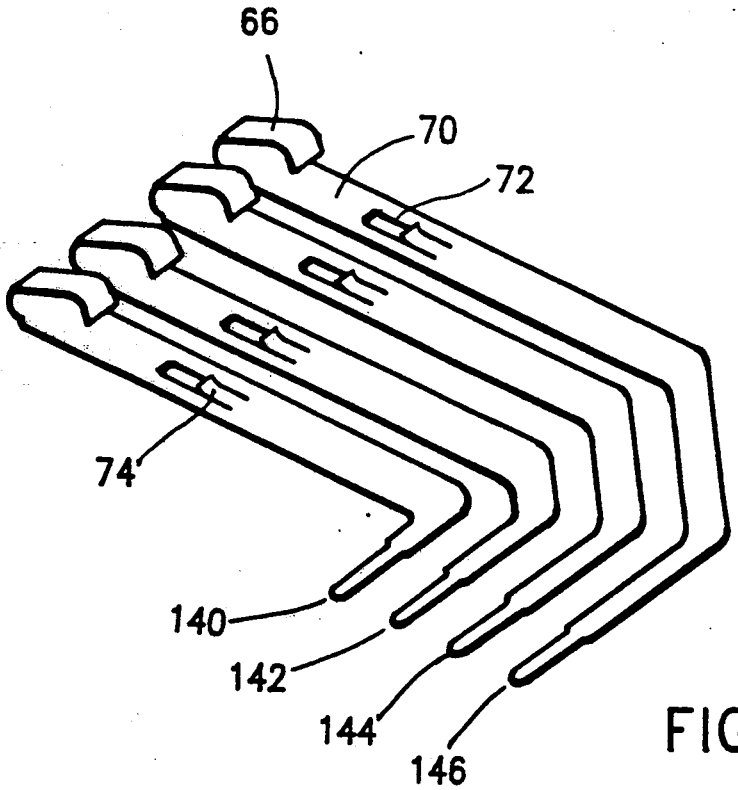
Figure 9A:
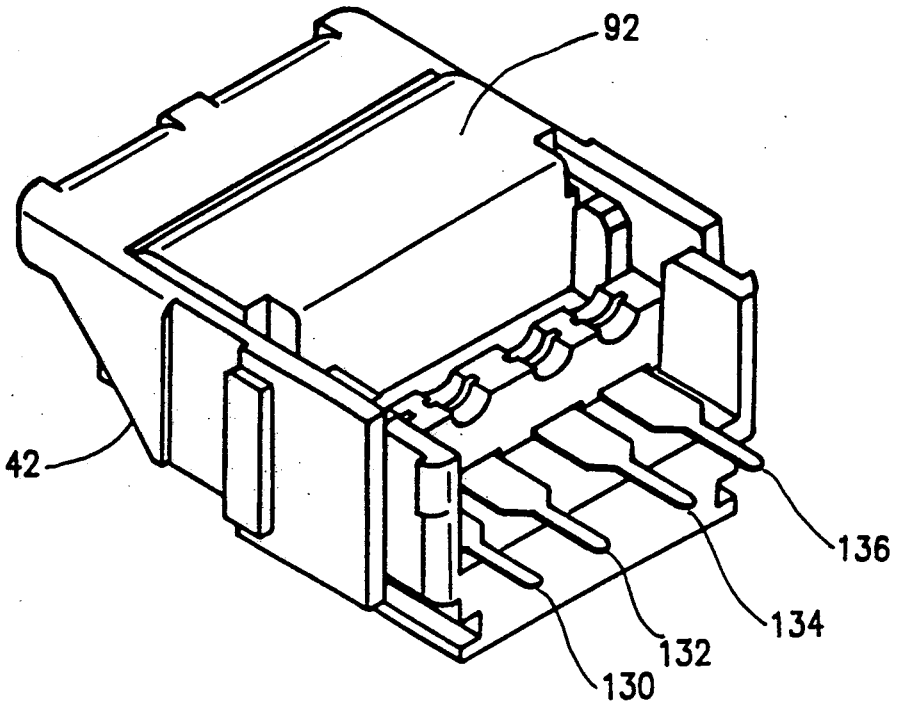
FIGS. 9A and 9B are pictorial illustrations of assembled interconnection modules corresponding to the two different alternative configurations of terminals in accordance with the present invention.
Figure 9B:
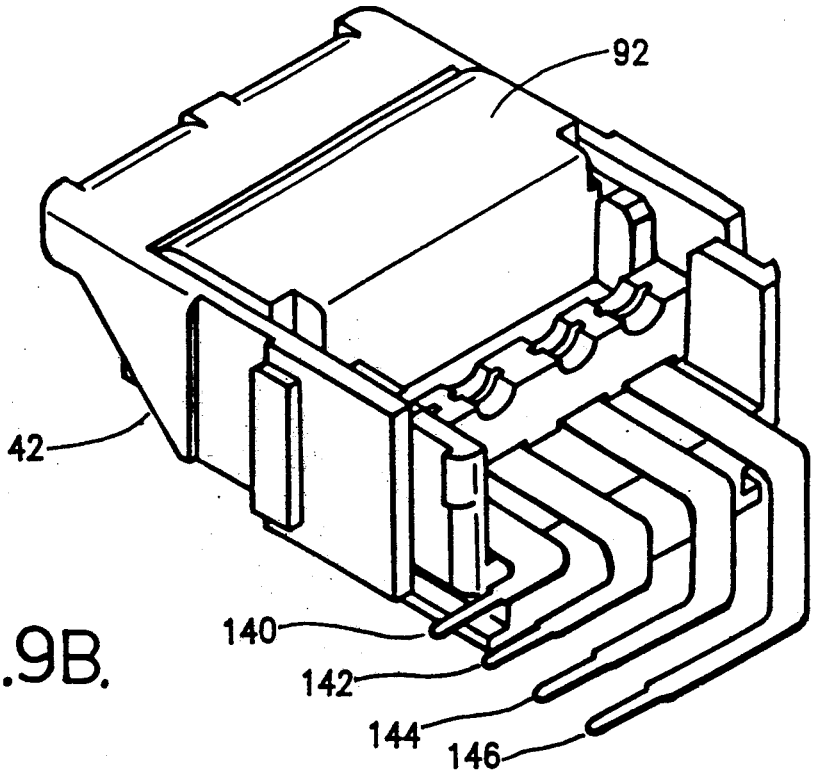

FIGS. 8A and 8B illustrate respective terminals 130, 132, 134 and 136 and 140, 142, 144 and 146 which may be employed instead of terminals 58, 60, 62 and 64 shown in FIG. 2. The corresponding interconnection modules are illustrated in FIGS. 9A and 9B respectively.

The remainder of the interconnection modules, the technique for assembly thereof, and the structure and operation of the shunt means remains the same. Instead of a cable connection to the terminals, a conventional printed circuit board connection is provided, thereby saving significant cost, space and time as compared to a cabled interconnection to the printed circuit board.

It will be appreciated by persons skilled in the art that the present invention is not limited by what has been particularly shown and described hereinabove. Rather the scope of the present invention is defined only by the claims which follow:

I claim:

1. A hermaphroditic self shorting electrical connector comprising:

a housing;

a plurality of electrical terminals supported within the housing; and electrical shunt means including at least one resilient conductive member having first and second end portions and an intermediate portion, positioned and configured such that when the connector is in an unmated condition, said first end portion and said intermediate portion of the resilient conductive member are each in electrical terminals and such that mating engagement of the connector with a corresponding connector produces engagement with said second end portion of the resilient conductive member which deflects the resilient conductive member such that said intermediate portion breaks contact with the electrical terminal with which it was in contact with the result that said resilient conductive member is in electrical contact with one but not both of the two electrical terminals.

2. A connector according to claim 1 and wherein said resilient conductive member is preloaded against said at least two electrical terminals.

3. A connector according to claim 1 and also comprising:

a unitary electrical shield disposed within the housing, at least partially surrounding the electrical terminals.

4. A hermaphroditic electrical connector according to claim 3 also comprising electrical shielding means including at least one integrally formed conductive portion for providing automatic grounding of the connector when it is coupled onto a conductive panel having IBM standard connection apertures.

5. A connector according to claim 1 and also comprising:

electrical shielding means including at least one integrally formed conductive portion of providing automatic grounding of the connector when it is coupled onto a conductive panel having IBM standard connection apertures.

6. A connector according to claim 1 and wherein said electrical terminals are directly connectable to a printed circuit board.

7. A hermaphroditic electrical connector according to claim 1 and also comprising electrical shielding means consisting of only a unitary electrical shield disposed within the housing, at least partially surrounding the electrical terminals.

8. A hermaphroditic electrical connector according to claim 1 and also comprising one piece electrical shielding means including first and second generally planar portion which lie generally parallel to and on both sides of said planar array.

9. A hermaphroditic self shorting electrical connector comprising:

a housing;

a plurality of electrical terminals supported within the housing; and electrical shunt means including at least one resilient conductive member, positioned and configured such that when the connector is in an unmated condition, the resilient conductive member is in electrical contact with two electrical terminals and such that mating engagement of the connector with a corresponding connector deflects the resilient conductive member such that it is in electrical contact with one but not both of the two electrical terminals, and wherein said resilient conductive member is in the general form of a spiral spring.

10. A hermaphroditic self shorting electrical connector comprising:

a housing;

a plurality of electrical terminals supported within the housing; and electrical shunt means including at least one resilient conductive member, and at least one dielectric deflecting element, said electrical shunt means being positioned and configured such that when the connector is in an unmated condition, the resilient conductive member is in electrical contact with two of said electrical terminals and such that mating engagement of the connector with a corresponding connector deflects the resilient conductive member into engagement with said dielectric deflecting element which displaces the resilient conductive member such that it is no longer in electrical contact with at least one of the two electrical terminals.

11. A connector according to claim 10 and wherein said at least one resilient conductive member is positioned and configured such that mating engagement of the connector with a corresponding connector deflects the resilient conductive member such that it is in electrical contact with one but not both of the two electrical terminals.

* * * * *